US006371037B1

(12) United States Patent
Cook et al.

(10) Patent No.: US 6,371,037 B1
(45) Date of Patent: Apr. 16, 2002

(54) SAIL FURLING SYSTEM

(76) Inventors: Fred C. Cook, 59 Cliff Dr., Assonet, MA (US) 02702; David R Dion, 12 Olde Logging Rd., Marion, MA (US) 02738

( * ) Notice: Subject to any disclaimer, the term of this patent is extended or adjusted under 35 U.S.C. 154(b) by 0 days.

(21) Appl. No.: 09/748,514

(22) Filed: Dec. 26, 2000

(51) Int. Cl.[7] ..... B63H 9/04
(52) U.S. Cl. ..... 114/107; 114/108
(58) Field of Search ..... 114/106, 107, 114/108, 102.26

(56) References Cited

U.S. PATENT DOCUMENTS

| | | | | |
|---|---|---|---|---|
| 4,116,152 A | | 9/1978 | Larsson | 114/106 |
| 4,597,347 A | | 7/1986 | Spanopoulos | 114/106 |
| 4,606,292 A | | 8/1986 | du Temple de Rougemont | 114/106 |
| 4,811,677 A | | 3/1989 | Pedersen et al. | 114/106 |
| 5,632,215 A | | 5/1997 | Moessnang et al. | 114/106 |
| 5,640,919 A | | 6/1997 | Huisman | 114/106 |
| 5,697,314 A | | 12/1997 | Clausin | 114/106 |
| 6,145,460 A | * | 11/2000 | Brookes | 114/106 |

* cited by examiner

*Primary Examiner*—Jesus D. Sotelo
(74) *Attorney, Agent, or Firm*—Mark P. White

(57) ABSTRACT

A roller furling system for sailing yachts contains a rotating mandrel mounted within a boom of the vessel, and furls or reefs the sail within the boom. The furler includes the hollow boom which has a slot on the upper surface to permit the sail to enter, foot first. A rotating mandrel is mounted within the boom and a drum, attached to the after end of the boom and concentric with the mandrel, provides means to rotate the mandrel. A winding line is wound around the drum and is redirected by a series of pulleys out of the forward end of the boom. The boom is mounted on, and above a gooseneck fitting attached to the mast, thereby providing full access to the mast end of the boom slot. A sail feeder provides easy entry of the sail into the boom slot, and prevents jamming, particularly jamming caused by the forward end of the sail battens. The feeder has two sides along the boom slot, and an end piece, which prevents the batten ends from jamming above the end of the boom slot. The luff of the sail is attached to a luff extrusion having a U-shaped cross section, which rotates about an axis close to, and parallel to the mast to which it is attached. The weight of the drum and pulleys at the after end of the mast is supported by a boom vang. An offset halyard box is also used at the top of the luff extrusion to maintain an efficient airfoil. In an alternate embodiment, the drum is caused to rotate by a motor located in proximity to the drum, and coupled by a gear reduction train.

19 Claims, 19 Drawing Sheets

SAIL FURLING SYSTEM

BACKGROUND OF THE INVENTION

1. Field of the Invention

This invention relates to a mainsail furling system containing a boom-mounted furler, intended for use in yachts.

2. Description of the Prior Art

Roller furlers and reefers for use in sail boats are well known, especially in the case of yachts[1]. These devices provide convenience and ease of use, as they can generally be handled by a single person, usually from the cockpit of the sail boat, and often by the helnsman. This is true even on yachts whose length is in excess of 40 feet, whereas, before the advent of roller furlers is was necessary to have two or more people to handle the hoisting and lowering of sails. However, the convenience of prior art furling systems has often been offset by a diminution in the performance of the sails.

The traditional usage of the word "yacht" is used here: a sailing boat used for pleasure.

Furling and reefing a separate, but related, activities: furling denotes the complete retirement of the sail from use, wherein the furled sail no longer presents any cross section to the wind for the purpose of driving the boat. Reefing, on the other hand, refers to the shortening of sail by reducing the sail area so as to provide less cross section to the wind, reducing the driving force of the wind on the sail. Since most furlers are also used as reefers, the terms will be used interchangeably herein.

Some furlers are designed to be used with sails normally mounted on the stays of a vessel, more particularly on the jibs of sailboats. Others, generally referred to as mainsail furlers, operate on sails which are affixed to two spars at right angles to each other, usually the mast and boom. So-called mainsail furlers are also used on the mizzen sails of ketches or yawls, on the sails mounted on the foremasts of schooners, and so forth. They will all be referred to herein as mainsail furlers for the purpose of this description, and the sails they control will be referred to as mainsails.

Mainsail furlers present a much more difficult design problem than jib furlers, since the jib furler is attached along its luff to a stay, and may be simply wound around the stay like a window shade. The mainsail furler, on the other hand, having two long lines of attachments to two spars perpendicular to each other, has problems unique to its geometry.

Many of the first mainsail furler designs furled the mainsail within the mast ("mast furlers"), allowing the foot of the sail to slide along the boom toward the mast when the sail is furled. These system have certain disadvantages over the systems in which the sail is furled on or within the boom ("boom furlers"). First of all, the mast furlers require a main part of the apparatus within the mast itself, thereby increasing the weight aloft, and affecting the stability of the vessel under sail. Furthermore, the mast furlers present a nasty maintenance problem, in the case of malfunction or damage to the system. Often, someone is required to go aloft to repair even simple malfunctions, such as jams, which is an unhappy situation for many amateur sailors.

Boom furlers, on the other hand, present their own unique problems. The preferred boom furler at present contains a rotating mandrel mounted within the boom, with a drum at the mast end of the boom. In some embodiments of the prior art the foot rope of the mainsail is affixed to the mandrel along its length. In others, the mainsail is attached only at the tack and clew, that is, the ends of the foot. A winding cord is wound around the drum, and exits through the mast end of the boom. When the sail is hoisted, the winding cord winds itself about the drum; when furled, the user pulls on the winding cord, causing the mandrel to rotate, winding the sail about the mandrel. The drum has large side plates, to keep the winding cord from wandering off the drum and jamming the mechanism. Furthermore, the drum must be rather elongated, since it must fit within the boom, and must provide room for a length of winding cord equivalent to the height of the mainsail, wound about the drum.

A prior art furling system is shown in FIG. 1. Referring now to FIG. 1 (prior art), it is seen that in the luff 2 of the mainsail must be set back at least as far from the mast as the length 1 of the drum in this type of system, plus the width of bearing 4, and distance g of the gooseneck. As a result, the luff 2 is too far removed from the mast 6 to allow a direct connection by sliding a rope sewn into the luff (luff rope) into a slot in the mast, as is commonly done in non-furling mainsail rigging. Instead, a luff extrusion 8 is provided in these prior art systems, to which the luff is attached. Typically, the luff extrusion contains slots to allow insertion of the luff rope, similar to the way the mainsail luff is attached to the mast in non-furler systems. The luff extrusion 8 is affixed to the mast by supports 10, and are affixed non-rotatably to the mast.

Thus, when the boom begins to rotate with respect to the mast, it does so along axis a, which passes through the pin 12 of the gooseneck. The sail, on the other hand rotates about axis b, which, in some prior art implementations, is at some distance from axis a. In such systems, the set of the sail is impaired, and the luff extrusion is subjected to a twisting, with the top of the sail not parallel to the bottom along the luff line. This type of twist diminishes said sail performance.

Furthermore, the large slot is created between the mast and the luff of the sail. Although this so-called "slot effect" has been extolled by purveyors of this particular design, it should be noted that no manufacturer to date has introduced this slot in the absence of the need to do so because of the furler design. It is generally believed that such a large slot diminishes sail performance, rather than enhancing it.

Placing the drum at the after end of the boom, and in the current invention, presents a number of improvements over the prior art. Most noticeably, the luff of the sail is in close proximity to the mast, as shown in FIG. 2. The supports have been reduced in size, thereby reducing the torsional stress on the supports caused by the misalignment of the center of rotation of the gooseneck and that of the luff of the mainsail. In some designs, the luff may be attached directly to the mast by means of a mast slot, thus doing away with the supports altogether.

The present design further incorporates a guide which facilitates entry of the lower portion of the mainsail into the opening in the boom through which the mainsail enters. This guide is especially important in the case of the luff end of battens entering the boom opening.

An additional feature of the present invention is the use of a luff-extrusion, which has a U-shaped cross section, with the arms of the U long enough to support the leading edge of the sail battens, and create a compression of the sail batten, thus maintaining the sail shape properly. The reason for this feature may be understood by referring first to FIG. 2*a*, which shows a prior art system for attaching the mainsail to the mast.

Referring now to this figure, it is seen that the mainsail 110 is attached to the mast 6 by means of a luff rope 112 which slides in a slot in a luff extrusion 8 which is attached to the mast. The boat in this figure is "in irons", or "heaved to"—that is the boat direction 120 is faced directly into the wind 100, and the sail in this figure is accordingly limp, and there are no forces exerted on the luff rope or sail luff. The boat will not advance under this point of sail, but lies motionless in the water, except for the effects of the tide, or the wind blowing on the hull.

When the boat falls off the wind a bit and comes onto close-hauled position, as depicted in FIG. 2*b*, where the wind 100 is now at an acute angle with respect to the boat direction 120, the situation changes significantly. The sail is attached at its after end, or clew 118, at the after end of the boom. As a result, the pressure of the wind causes the sail to belly out somewhat, as shown, and a compression force vector 114 is exerted on the luff 2 of the sail, driving the luff forward, and out of line with the opening in the luff extrusion 8. The sail invariably contains battens, stiff wood, plastic, or metal material to stiffen the luff.

These battens 122 are located at intervals along the luff of the sail, as shown in FIG. 5, and are set in pockets 124, which maintain the battens in place. They may be any length from a foot or so, to a length which extends along the entire sail, from luff to leech, as is the case depicted in FIG. 5 ("fully battened" sails). The battens are subject to the compressive force caused by the wind during the point of sail shown in FIG. 2*b* and exacerbate the situation by pushing the battens into the forward end of the batten pockets. The result is to strain the sail material, causing it to chafe or pull apart. In addition, in the case of a fully battened sail, a strain is produced on the junction between the luff 2 and the luffrope 112.

FIG. 2*c* depicts the situation when the boat falls off still further and the wind 100 is dead aft. The wind still causes the sail 100 to belly, causing compression on the forward end of the sail, as in the previous example. The compression force vector 116, is now almost perpendicular to the direction 120 of the boat, and the chafing strain on the sail, and the compression strain at the junctions between the luff 2 and the luff rope 112 are even more severe than in the situation of FIG. 2*b*.

The luff extrusion cross section of the present invention solves the problem of sail wear by preventing the chafing and strain on the junction at the luff rope of the prior art.

On further problem addressed by the current invention involves the strain on the top, or head of the sail, caused by the misalignment of the head and the halyard, a rope which is used to hoist the sail to the top of the mast, and to maintain it there while under sail.

Referring now to FIG. 2*d*, the prior art is illustrated in regard to the alignment of the main halyard 198 with the center of rotation of the sail about the mast. This drawing illustrates the condition when the wind is blowing aft, and the sail 100 is extended as to be at right angles with the centerline of the boat 134. When the sail 100 is at right angles, as shown in this figure, the length of the halyard between the point where the halyard exits the masthead 130 and the headboard 132 of the sail is distance d2. It is clear from this drawing that when the mainsail 100 is rotated so that it is in line with the centerline of the boat, the distance from the masthead exit 130 and the headboard 132 of the sail will be distance d1. Furthermore, the greater the distance between d3 between the luff 2 and the mast 6, the greater the difference d2–d1 will be. On the other hand, if the axis of rotation of the luff is adjacent to the mast, then d2–d2 will be zero.

In practice, however, d2 is fixed, as the sail is normally hoist to the head of the mast, and cleated down, and this is normally done while the boat is facing directly into the wind. So the distance from the masthead exit to the head of the sail will be d2, and cannot increase without uncleating the halyard. As a result, when the sail attempts to rotate about the mast, the head of the sail will resist this rotation, and the top of the sail will contain a twist, distorting the set of the sail.

The present invention includes a remedy for this prior art problem, in that a mast halyard box is included which prevents twisting of the masthead.

In prior attempts at producing a boom furler with the drum at the after end of the boom, it was found that the extra weight so located made handling of the boom difficult, and placed additional strain on the sail. The present invention addresses this problem by using a solid boom vang to support the boom.

It has been further suggested that the leading of the winding cord through the mast end of the boom, and into the cockpit caused reliability problems with this type of furler. In one embodiment, the use of the winding cord has been eliminated by incorporation of a small, highly geared motor, driving the mandrel directly though a planetary gear system. Thus, the helmsman can operated the furler by means of an electrical switch, located at any convenient place, or places, in the cockpit, and elsewhere. As an alternative embodiment, the motor may be of a type, such as the stepper motor, which may be operated without the use of any gear system.

SUMMARY OF THE INVENTION

It is an object of the present invention to provide a sail furling system which is reliable, easy to use, and does not degrade sail performance by its use.

In accordance with one aspect of the invention, the roller furling system includes a hollow boom having a longitudinal axis, an upper surface, a forward end and an after end, with a slot along the upper surface. It includes a mandrel mounted within the boom, having an after end and a forward end, a drum, concentric with the mandrel, and affixed to its after end. Also provided are means to affix a foot of the sail to the mandrel, either along the entire foot, or at the tack and clew only; and means to rotate the drum within the boom. A rotatable boom coupling, affixed at one end to the forward end of the boom, and affixed at the other end to the mast, creates a transverse axis of rotation and also has a vertical axis of rotation parallel to the mast. The boom coupling, being disposed below the boom on the mast, exposes the entire boom slot, so that when the drum is rotated, the sail is furled about the mandrel within the boom.

In accordance with a second aspect of the invention, the furling system also a sail feeder, the sail feeder made up of two side pieces, affixed on either side of the boom slot, and extending upwards along a forward end of the slot, and an end piece, disposed between the boom slot and the mast, attached to each of the side pieces and to the boom itself. The two side pieces and the end piece forms a U-shaped structure when viewed from above, so that the sail is guided into the boom slot by the sail feeder as it exits from the bottom of the luff extrusion as the sail is wound about the mandrel.

In accordance with a third aspect of the invention, the system includes a boom vang, rotatably attached at one end to the base of the mast, and rotatably attached at the other end to an underside of the boom. This arrangement the rotation permits the boom to rotate only about an axis parallel to the mast. The boom vang thus constructed supports part of the weight of the boom, so that the sail shape is not distorted by the weight of the boom.

In accordance with a fourth aspect of the invention, the furling system includes a luff extrusion, having a vertical axis of rotation parallel to and in proximity to the vertical axis of rotation of the boom coupling. This vertical axis of rotation of the luff extrusion is formed by rotatable coupling the luff extrusion to a series of supports, each support rigidly attached to the mast at one end. The luff extrusion have one or more slots extending along its entire length, also have, formed within the extrusion, an extrusion slot, allowing a luff rope of the mainsail to engages with the extrusion slot, so that the mainsail is maintained in a position parallel to the mast and in close proximity to it.

In accordance with a fifth aspect of the invention, the luff extrusion has a vertical axis of rotation at an acute angle to the axis of rotation of the boom coupling. This axis of rotation passes in close proximity to the vertical axis of rotation of the boom coupling at the lowest point of the luff extrusion.

In accordance with a sixth aspect of the invention, the luff extrusion also includes one or more luff extrusion slots extending longitudinally along the length of the luff extrusion. The means to slidingly affix the luff rope to the luff extrusion include means to capture the luff rope within one of the luff extrusion slots.

In accordance with a seventh aspect of the invention, wherein the sailboat has one or more sails which are fully battened, the cross section of the luff extrusion has two or more substantially parallel arms equally spaced to contain the sails and battens. A batten guide is thus formed between each adjacent pair of arms, and the arms of sufficient length to maintain all the battens in compression under sail.

In accordance with an eighth aspect of the invention, the luff extrusion has formed within it the forward end a luff support slot, so that the luff supports are captured within the luff support slot.

In accordance with a ninth aspect of the invention, the system includes a forward bearing affixed to the mast end of the boom, which provides rotational support for the forward end of the mandrel. It includes, in addition, an after bearing, affixed to the after end of the boom, which provides rotational support for the after end of the mandrel.

In accordance with a tenth aspect of the invention, boom also contains a conduit, and the means for rotating the drum include an after pulley, a forward pulley, and a winding line, the winding line winding about the drum, then is redirected by the after pulley through the conduit along the longitudinal axis of the boom, and redirected again by the forward pulley out of the boom. When the sail is raised the drum line is wound about the pulley, the mandrel rotating in one direction, and when the sail is in the raised position and the drum line pulled, the drum and attached mandrel is rotated in the other direction, the sail being wound about the mandrel as a result.

In accordance with an eleventh aspect of the invention, the means for rotating the drum includes a motor, mounted in the after end of the boom in proximity to the drum.

In accordance with a final aspect of the invention, the motor is coupled to the drum by reducing gear means.

BRIEF DESCRIPTION OF THE DRAWINGS

These, and further features of the invention, may be better understood with reference to the accompanying specification and drawings depicting the preferred embodiment, in which:

FIG. 15*b* depicts a cross section of the luff extrusion of the preferred embodiment.

FIG. 15*c* depicts a first variation in the cross section of the luff extrusion.

FIG. 15*d* depicts a second variation in the cross section of the luff extrusion.

DESCRIPTION OF THE PREFERRED EMBODIMENTS

Figure 9:
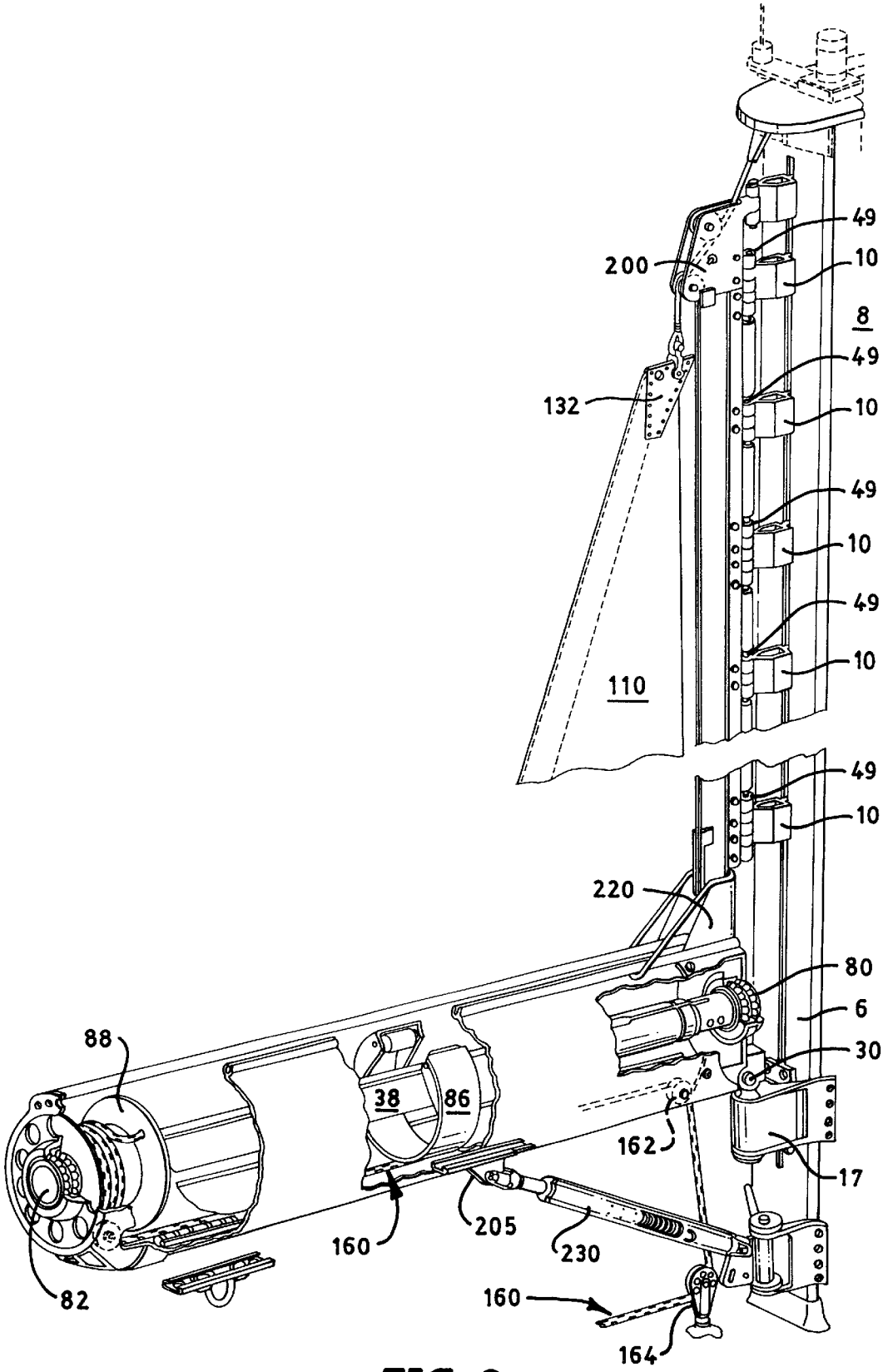
FIG. 9 depicts a perspective view of the preferred embodiment of the present invention.

The preferred embodiment may be understood by first referring to FIG. 9. The sail 110 is seen hoisted to the top of the mast 6. The foot of the sail is attached to the mandrel 38 along the entire length of the sail. Note that in alternative embodiments the foot of the sail is attached to the mandrel only at the tack and clew, rather than along its entire length. The luff of the sail is shown affixed to the luff extrusion 2. The luff extrusion is affixed to the mast by supports 10, of which are disposed along the mast. These supports are rigidly affixed to the mast. However, they are rotatable at the luff extrusion end, permitting the luff extrusion to rotate about the axis of the luff support pins 49 as shown. The boom is attached to the mast through the insertion of clevis pin 30, attached to the gooseneck 17.

These elements will now be described in detail.

The Boom Assembly

Figure 3:
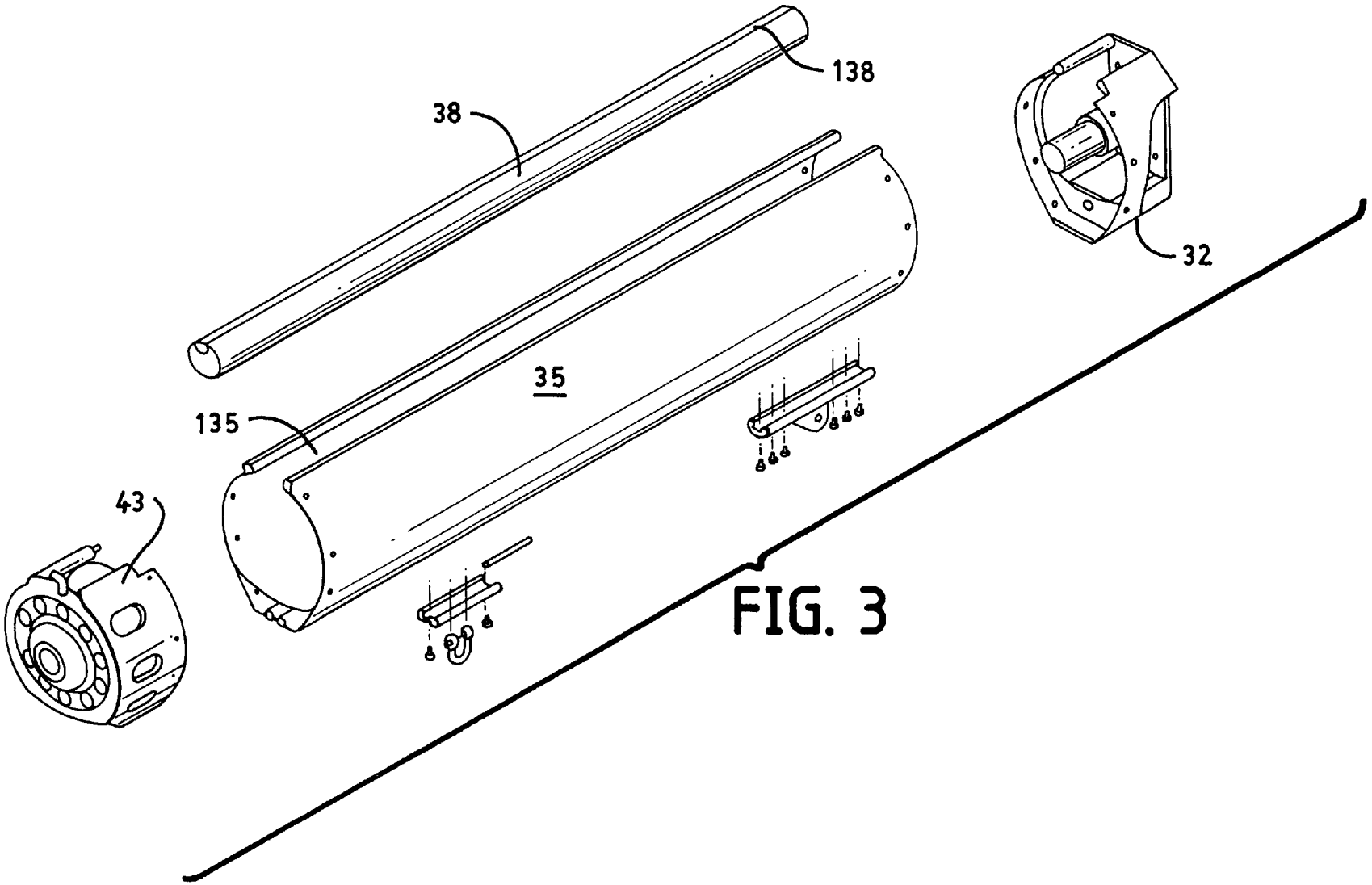
FIG. 3 depicts an exploded view of the boom assembly.

Referring now to FIG. 3, boom 35 has a boom slot 135 which opens upward, permitting entry of the sail. The mandrel 38, likewise contains a mandrel slot 138, which captures the foot rope of the sail, attaching it to the mandrel in this way. The boom ends 43, 32 contain bearings to allow the mandrel to freely rotate under load.

These bearings consist of forward bearings 80 and aft bearings 82, as shown in FIG. 9. Also shown in FIG. 9 are the furling guide 86. The positioning of the drum assembly 88 is also revealed in this figure.

Figure 3A:
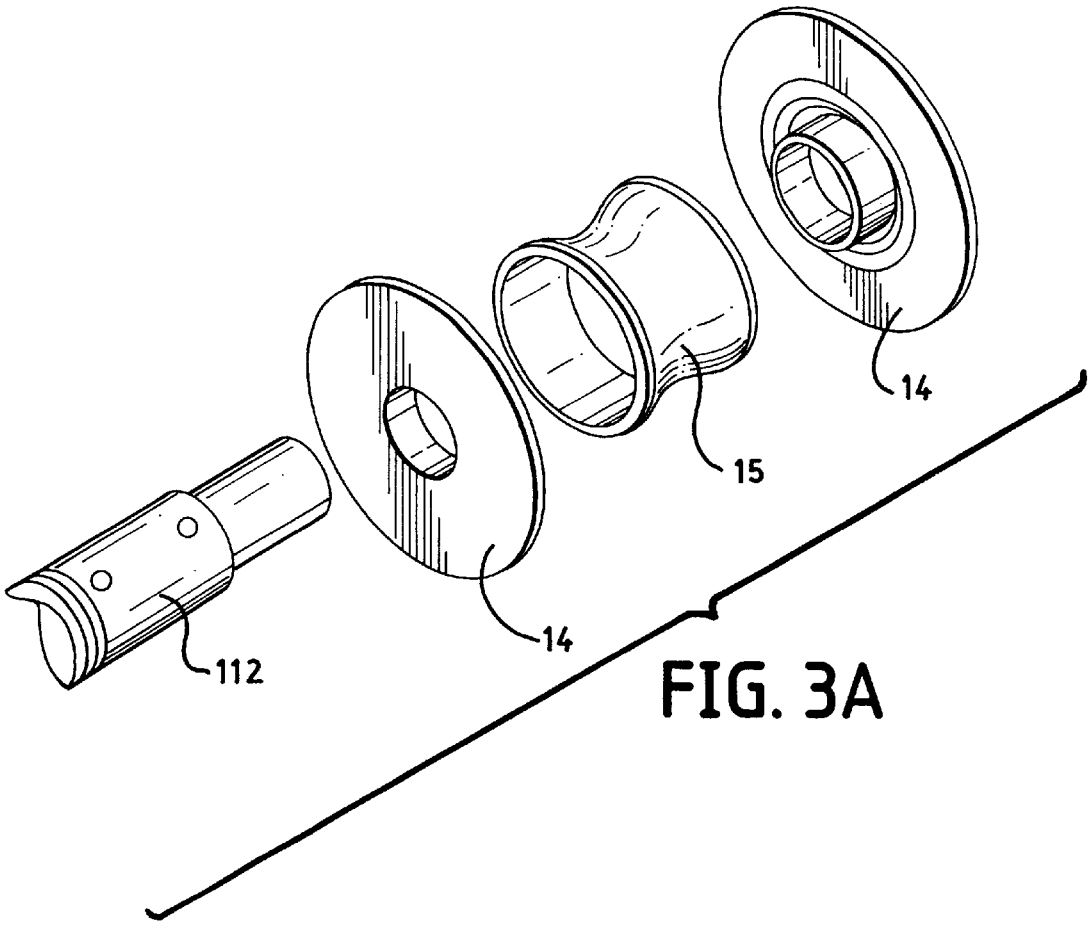
FIG. 3*a* depicts an exploded view of the drum assembly.

FIG. 3*a* shows the drum assembly in detail. The drum is made up of a drum unit 15, with identical drum plates 14 on either side. The inner race 112, attached to the mandrel, passes through the holes in the drum plates, which are affixed to the drum. The assembly is located at the after end of the mandrel, at the very end of the boom, as seen in FIG. 9.

The Boom Vang

Figure 8:
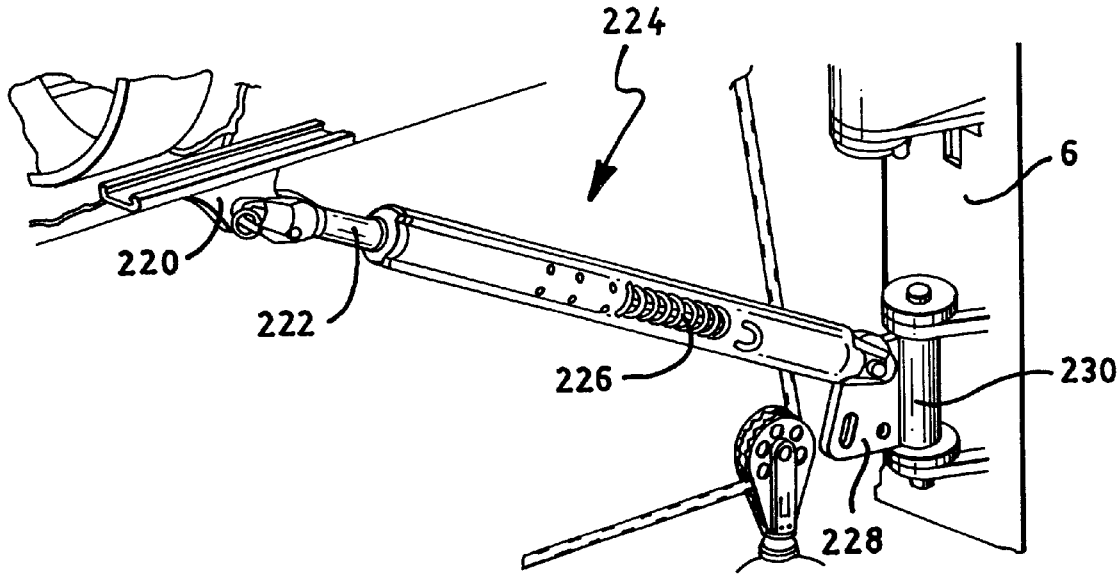
FIG. 8 depicts a perspective view of the boom vang.

Referring now to FIG. 8, the boom is shown supported by a boom vang. The boom vang provides support for the mast somewhat aft of the boom. It both prevents the boom from pulling up when sailing downwind, and assists the sail in supporting the boom in the other direction, thus reducing vertical stress on the sail.

The boom vang is seen to consist of a vang rod 222, which fits within a vang housing 224, and the connection between these two components is made by means of spring 226. The spring resists compression and tension equally, resisting changes in the length of the boom vang, similar to the actions of a car's shock absorber.

The vang rod attaches at its upper end to boom plate 220, and at its lower end to mast plate 228, which is free to rotate about the mast 6 by means of fitting 230. Since the boom vang is free to rotate with the boom, the length of the boom vang will not generally change unless subjected to strong vertical forces The Luff Extrusion It should be noted that although the term extrusion is used throughout this document, and the part is, indeed, normally formed by extrusion of aluminum or similar metal, it need not be made by this process. This assembly is also referred to as the "sail track".

Figure 2A:
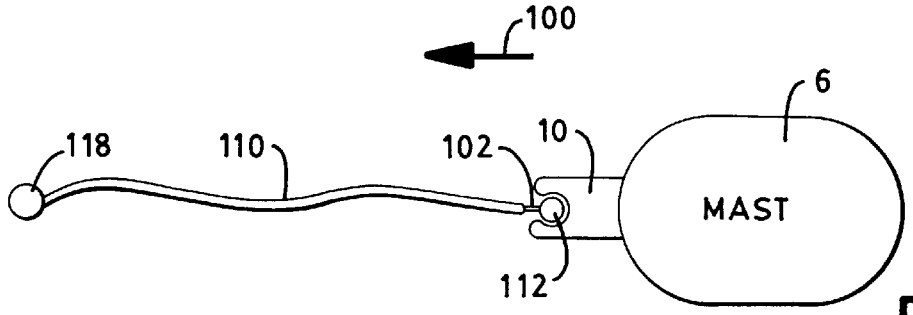
FIG. 2A (PRIOR ART)
FIG. 2*a* depicts a top plan view of a prior art luff extrusion, with the wind directly forward.
Figure 2B:
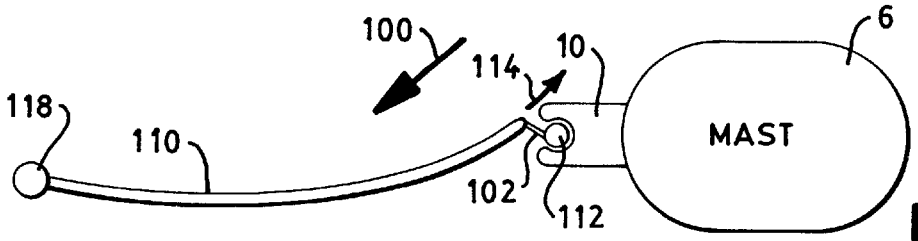
FIG. 2B (PRIOR ART)
FIG. 2*b* depicts a top plan view of a prior art luff extrusion, with the wind direction as when close hauled.
Figure 2C:
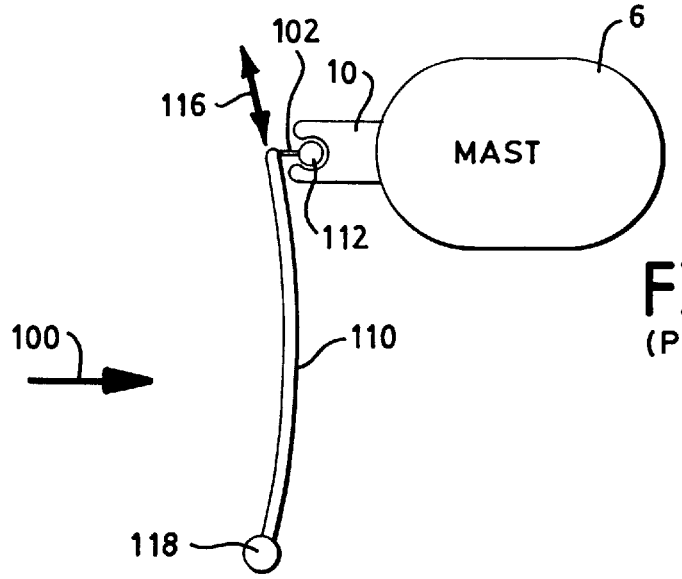
FIG. 2C (PRIOR ART)
FIG. 2*c* depicts a top plan view of a prior art luff extrusion, with the wind directly aft.

The luff extrusion is an important component of the current invention, because it both permits rotation of the sail about the mast to insure a proper sail set, and it further prevents sail damage from chafing and pulling as in the prior art as previously described. (See FIGS. 2*a* through 2*c*).

Figure 6:
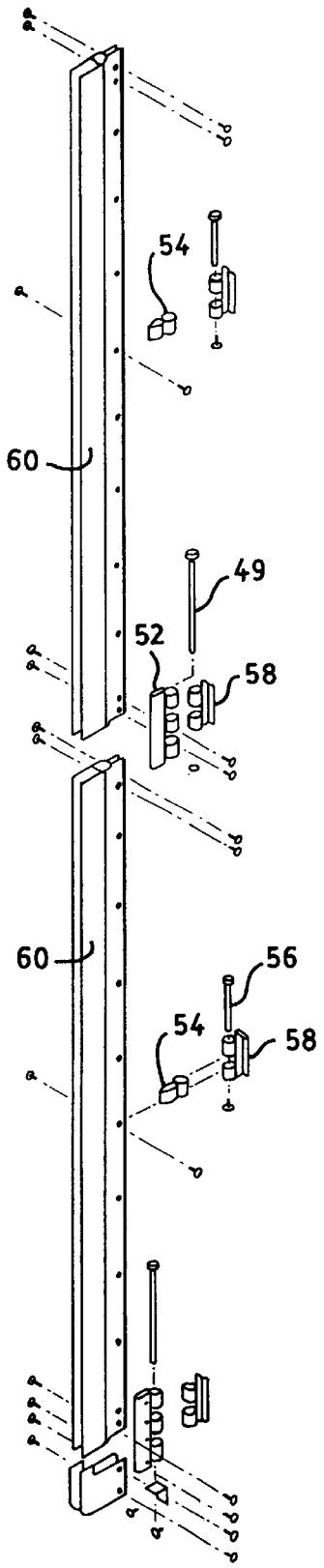
FIG. 6 depicts perspective exploded view of the luff extrusion.

Referring now to FIG. 6, the construction of the mast extrusion assembly may be seen. This sail track itself 60 is attached to the mast by means of supports 58, which are rigidly affixed to the mast. At the sail track end the sail track connectors 54 and long sail track connectors 52 are rigidly attached to the extrusion. Articulation is accomplished by track slide bolts 49, 56. It is noted that the luff extrusion thus rotates about an axis which is extremely close to the mast itself. This result is accomplished by the location of the drum at the after end of the boom, as previously mentioned.

Figure 12:
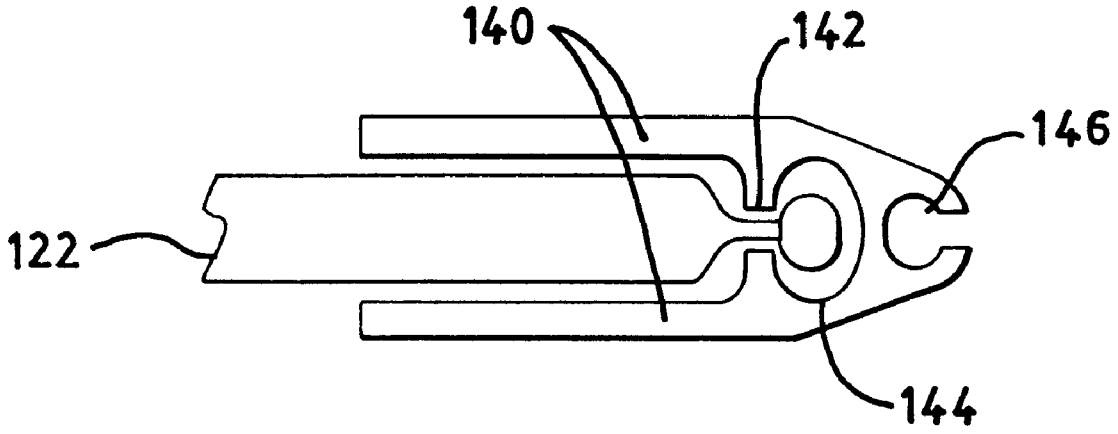
FIG. 12 depicts a top plan view (cross section) of the luff extrusion of the current invention.

Referring now to FIG. 12, the cross section of the extrusion is seen in top plan view. The luff extrusion has two arms 140, which extend about the mainsail luff and its battens, forming a batten guide between them. The luff rope is trapped in luff rope slot 144, in which it slides. Luff passage 142 is reduced in size so that the luff rope cannot be pulled through. Track support slot 146 captures the track connectors 52, 54, which in turn attach to mating connectors 58, as seen in FIG. 6. The track slide pins 56 establish the center of rotation of the luff extrusion about the mast.

Figure 17:
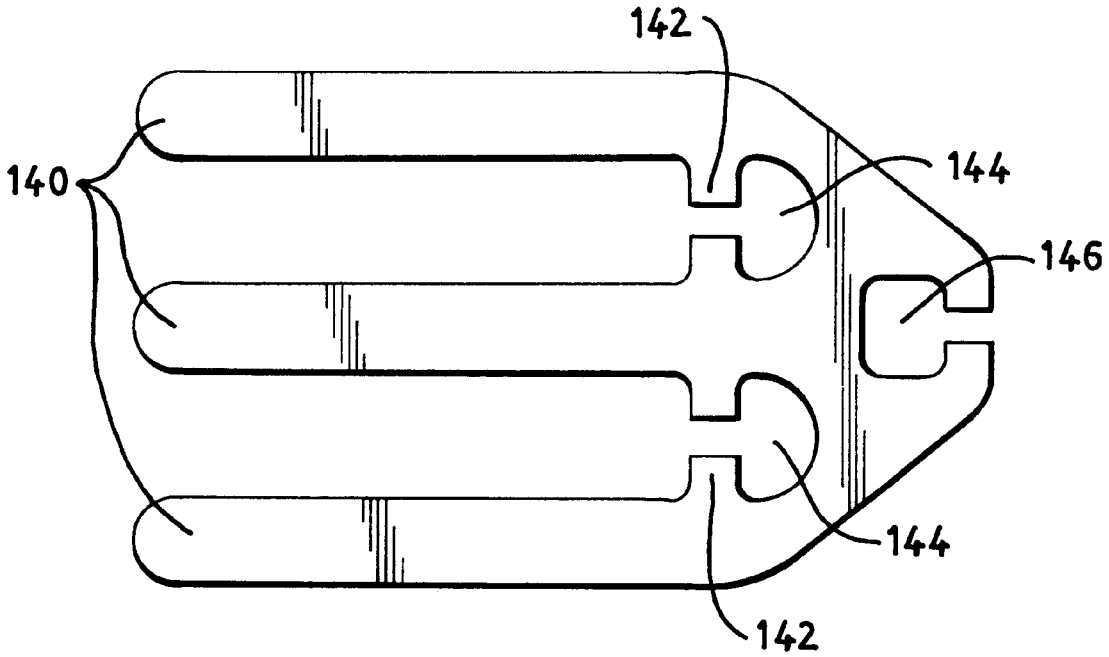
FIG. 17 depicts a cross section of the luff extrusion of an alternate embodiment having provisions for two different sails.

An alternative embodiment of the luff extrusion cross section is depicted in FIG. 17. In this alternative embodiment, the luff extrusion has three arms 140, allowing the luff ropes of two separate sails to be captured within the two luff rope slots 144, which communicate with the reduced-cross-section passages 142. Each pair of adjacent arms forms a batten guide between them. A single mast track slot 146 allows for attachment of the luff extrusion to the mast, as in the preferred embodiment.

The alternative embodiment permits easier handling of mainsails when two different mainsails are used at different times, especially when the two different sails have distinct halyards, as when racing, or under bad weather conditions. By means of this alternative embodiment, the sails may be alternated without connecting and disconnecting a single halyard to the two different sails.

Using the above principle, luff extrusions with provisions for two, three, or more sails may be created, allowing the handling of these sails without re-rigging.

The luff extrusion is made of a hight, compliant material, such as aluminum. It is manufactured as a substantially straight piece, or it may be fabricated in sections, as shown in FIG. 6, which are bolted together. Because the sail will have a twist at the luff from top to bottom, the luff extrusion must have a memory so that it returns to a straight configuration when the pressures inducing the twist are relieved. It is extremely undesirable for the luff extrusion to remain twisted in the absence of any twisting forces, as the sail shape would be impaired if it did remain twisted. The nature of the twisting phenomenon is described below.

A luff extrusion suitable for a sloop with an overall length of between thirty and forty feet has arms 140 between ¾ inch and one inch in length. The luff rope slot is about ⅝ inch in width, and slightly greater than ¼ inch in length, so that a ¼-inch luff rope is accommodated. The track support slot is about ¾-inch in length. At its point of greatest width, the cross-section measures about ⅞ inch.

The opening between the arms is lightly over ½ inch wide, so that the width of the sail, including battens inserted in their pockets, must be no greater that ½ inch.

Figure 13A:
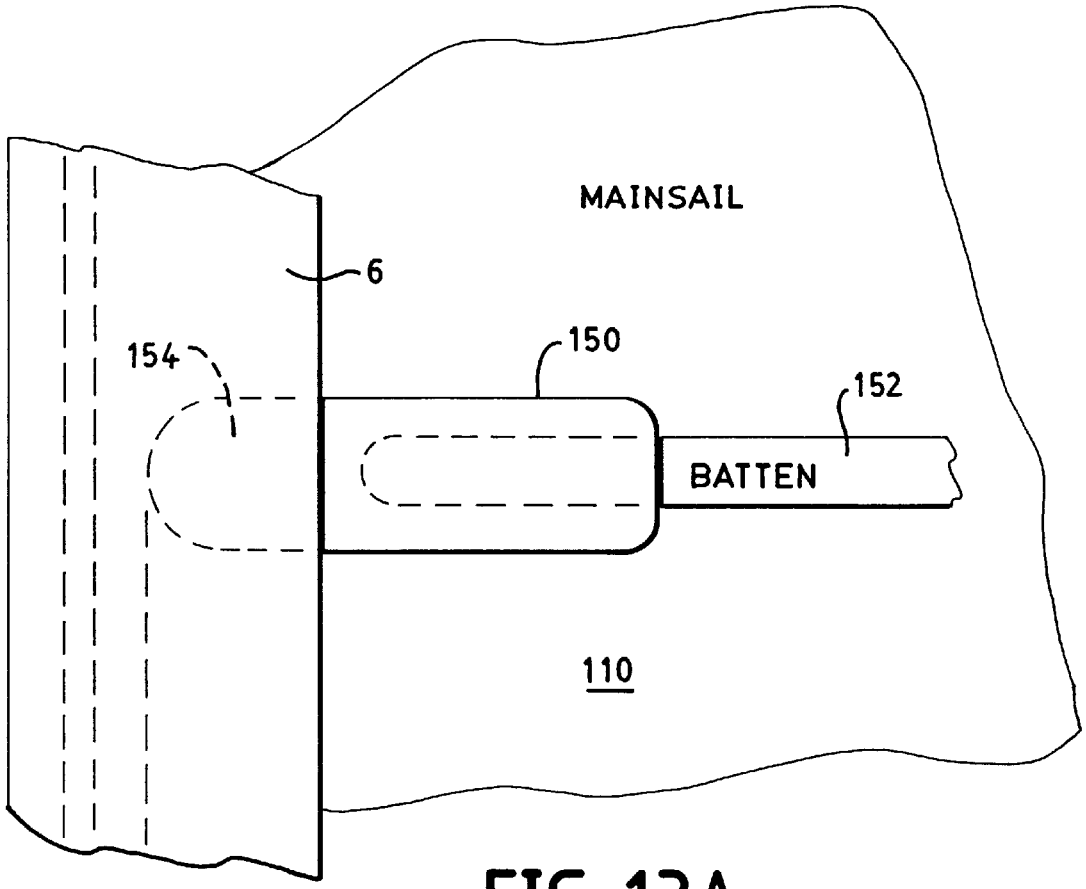
FIG. 13A a depicts a side elevation view of the system for use with a batten extension attached to the mainsail.
Figure 13B:
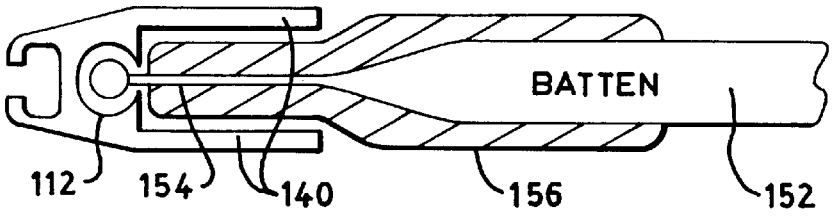
FIG. 13B depicts a cross-sectional view of the luff extrusion variation for use with a batten extension attached to the mainsail.

The U-shaped luff extrusion is also applicable for systems in which the battens are contained within batten receptacles. Such a system is shown in FIG. 13*a* and FIG. 13*b*. The batten receptacle designed to provide a reinforced area, which will further prevent wear on the sail and batten pocket in the vicinity of the receptacle.

Referring now to FIG. 13*a*, which is a side elevation view of the luff extrusion, batten receptacle and batten, the receptacle 150 is attached to the mainsail 110, by means which include sewing and gluing. The batten 152, is contained within the receptacle at is forward end, while the after end is contained within the sail pocket as with non-receptacle sails. The receptacle 150 is shown extending into the luff extrusion 60.

Referring now to FIG. 13*b*, the forward part 154 of the receptacle fits between the arms 140 of the luff extrusion, while the wider, after end 156 of the receptacle is without the luff extrusion, and contains the forward end of the batten 152.

It can be seen that this arrangement allows a larger, more substantial, and stronger batten, which stays entirely within its batten pocket. The luff rope is a farther away from the batten than in the conventional arrangement. There is virtually no chafing between the batten pocket and the luff extrusion, as the batten pocket is completely surrounded by the receptacle, which supports the forward end of the batten. Any sliding contact required to raise and lower the sail takes place between the arms of the luff extrusion and the receptacle, and not the sail.

Figure 15A:
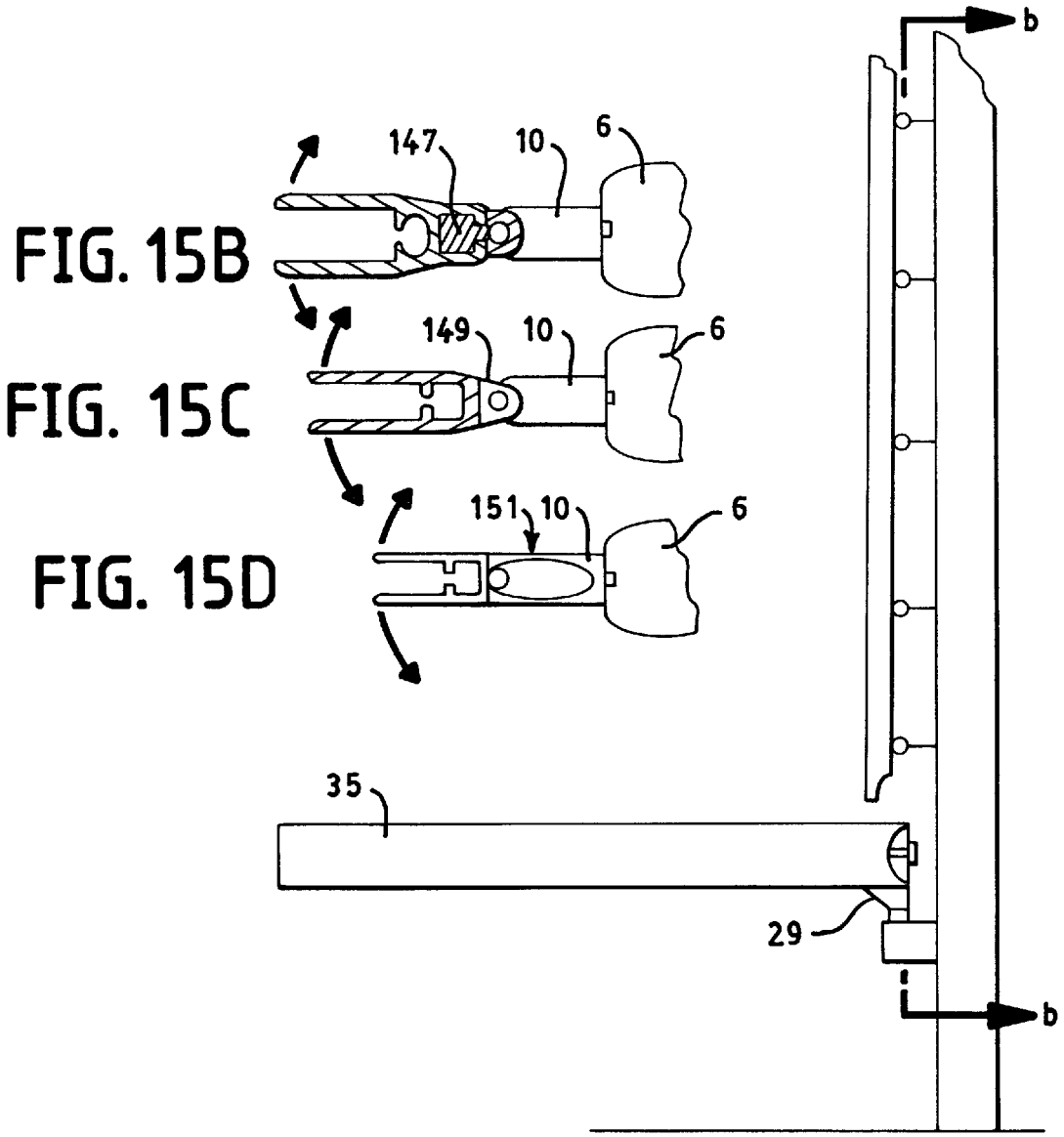
FIG. 15*a* depicts a side elevation view of the main mast and boom, the mast attached to a luff extrusion by means of track support.
Figure 16:
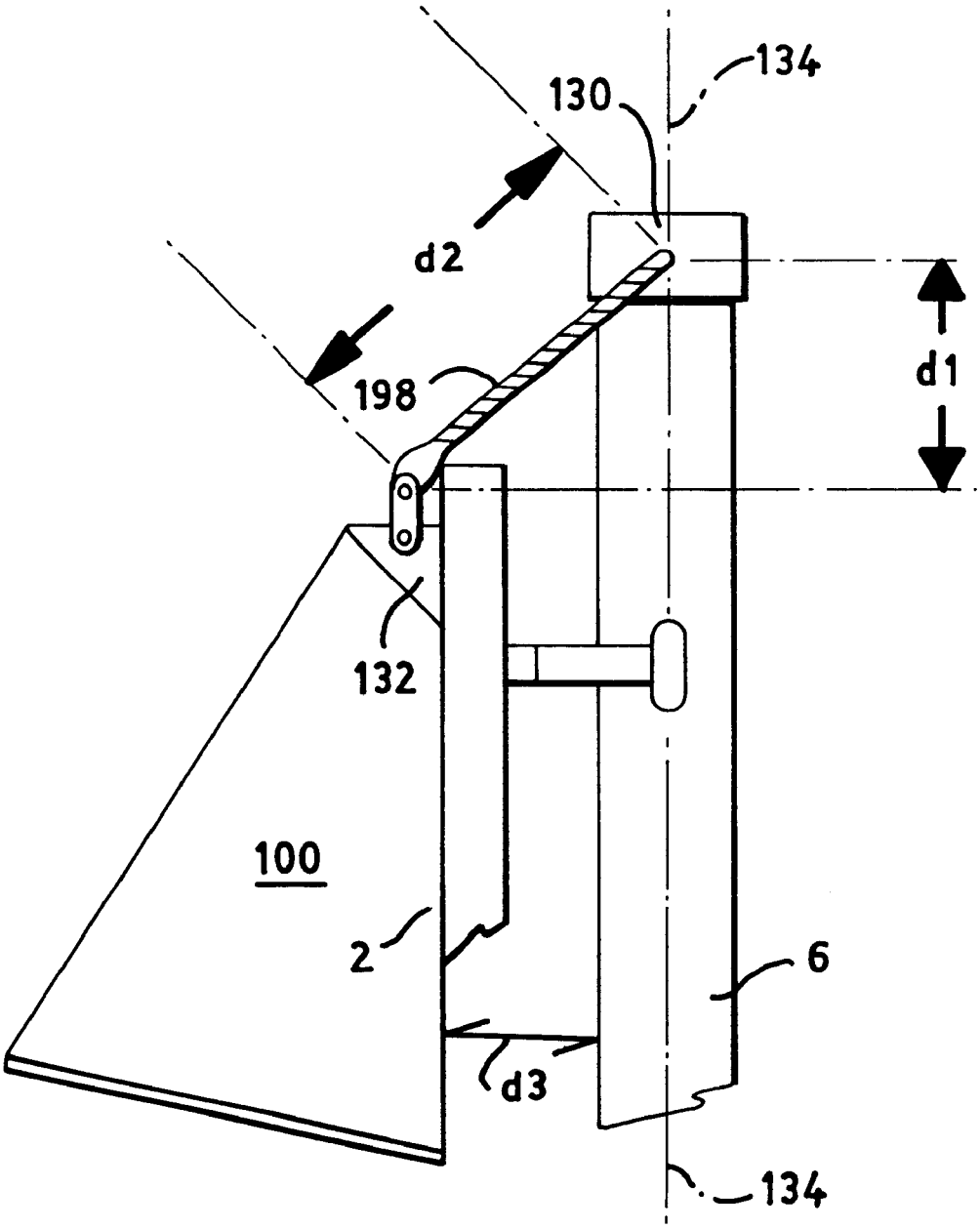
FIG. 16 depicts a rear plan view of a prior art mast and mainsail, illustrating the difference in length of the main halyard, from the mast head to the head of the mainsail, when the sail is at right angles to the centerline of the boat, and when the sail is aligned with the centerline of the boat.

Referring now to FIGS. 15*a* through *d*, several different variations of luff extrusion cross sections are shown. FIG. 15*b* shows the luff extrusion in accordance with the first preferred embodiment, as described above, and as shown in FIG. 12. Shown in this FIG. 15*b*, but not in FIG. 12, is luff hinge plate 147, which is captured within track support slot 146. The luff hinge plate contains a hole through which a luff hinge pin passes, allowing rotation of the luff extrusion about the corresponding mast support 10.

FIG. 15*c* shows a variation in the cross section of the luff extrusion, in which a first alternative luff hinge plate 149 is integrally attached to the forward end of the luff extrusion 60 adjacent to each track support 10.

The second alternative luff extrusion shown in FIG. 15*d* is a variation of that shown in FIG. 15*c*, whereby the profile of the second alternative luff hinge plate 151 is extended toward the mast, as shown in the figure. The variation shown in FIG. 15*d* produces a stronger joint due to the overlap with the track support.

Figure 2E:
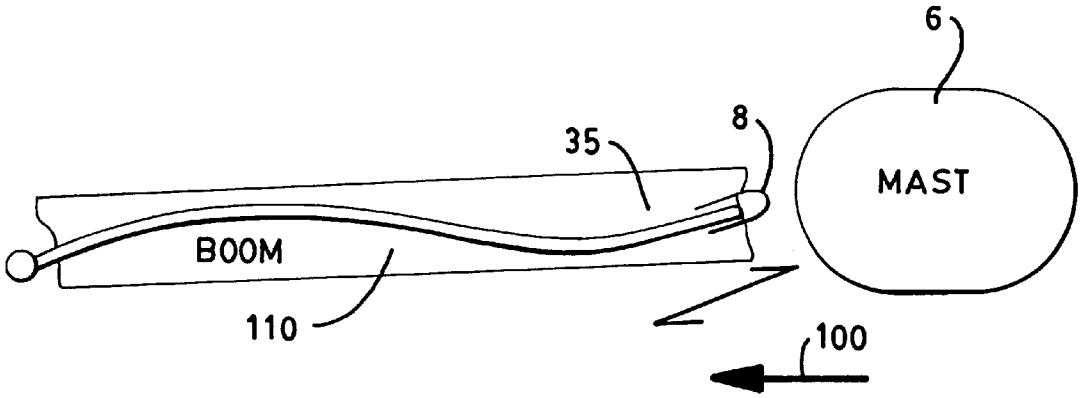
FIG. 2*e* depicts a top plan view of the luff extrusion of the present invention, with the wind directly forward.
Figure 2F:
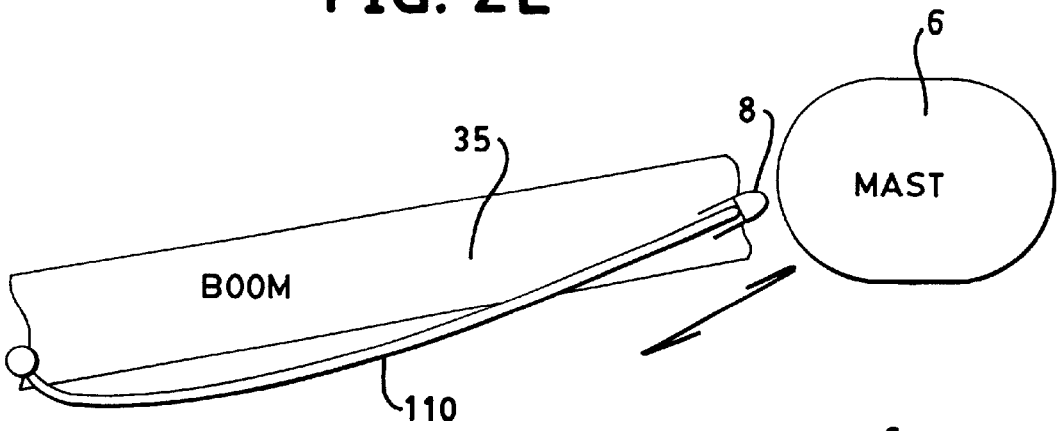
FIG. 2*f* depicts a top plan view of the luff extrusion of the present invention, with the wind direction as when close hauled.
Figure 2G:
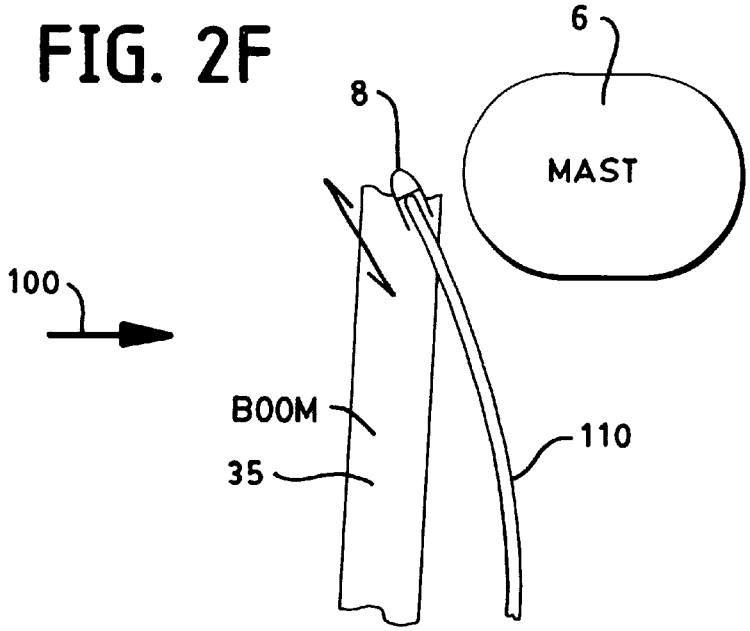
FIG. 2*g* depicts a top plan view of the luff extrusion of the present invention, with the wind directly aft.

Referring now to FIGS. 2E, 2F, and 2G, the difference in performance between the prior art and the luff extrusion of the current invention is demonstrated. In FIG. 2E, where the boat is in irons, there is no compressive pressure between the battens and the luff extrusion, and the sail is easily maintained within the extrusion by the luff rope, and in the prior art shown in FIG. 2*a*. Under the conditions shown in FIG. 2F, however, when the boat is sailing close hauled, the battens are under compression, which drives the battens further forward into the U-shaped luff extrusion 8, but without chafing or pulling. The compression is countered by the luff extrusion itself, and not on the sail. The same is true when the wind is aft, as depicted in FIG. 2G, which may be compared with the prior art shown in FIG. 2*c*.

Regardless of which of these variations is used, it is preferred for the maintenance of a proper sail shape that the axis of rotation b—b of the luff extrusion about the mast aligns with the pin 29 of the gooseneck, as illustrated in FIG. 15*a*, which provides for a proper sail shape for all points of sailing.

Figure 11:
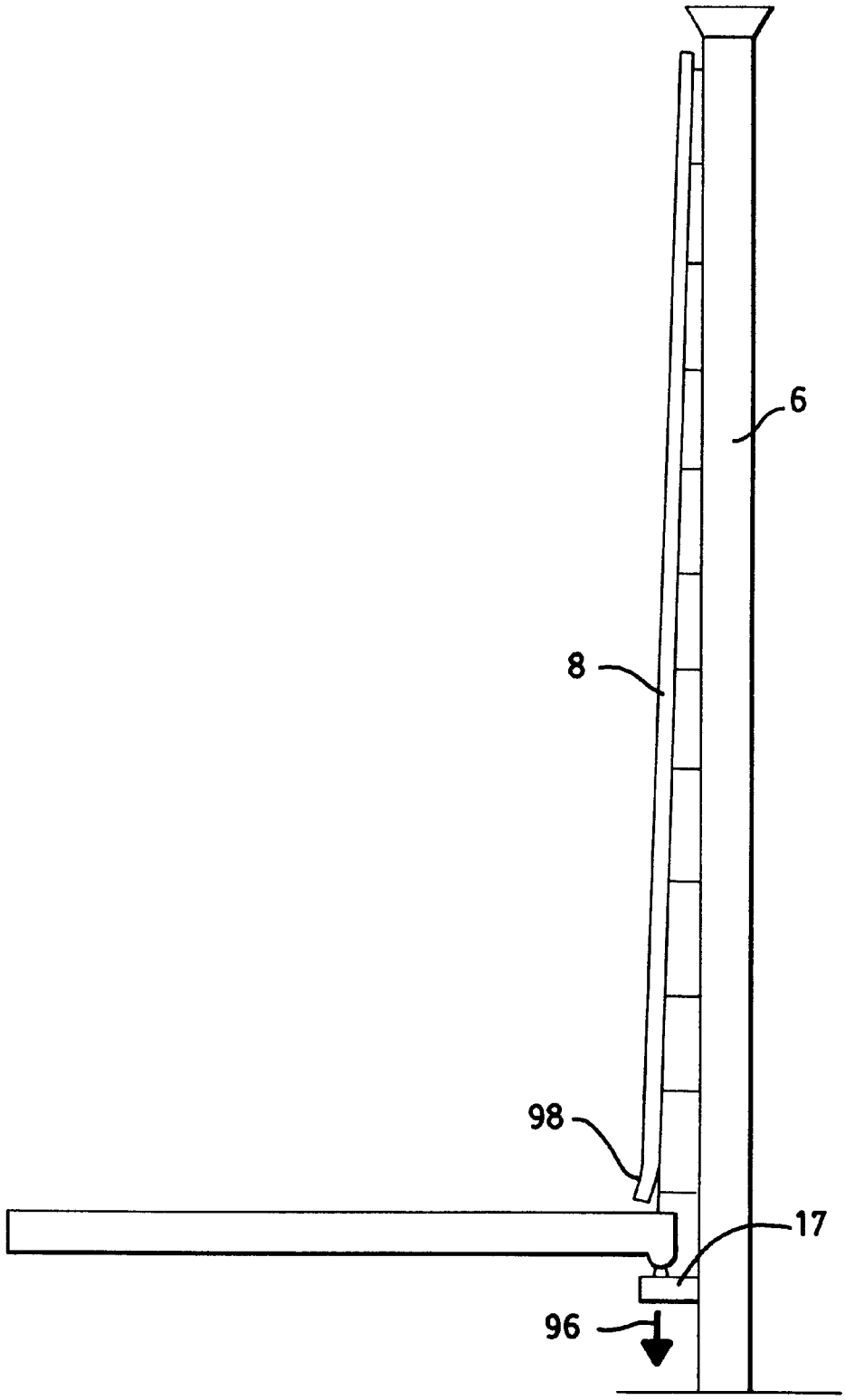
FIG. 11 depicts a side elevation view of a luff extrusion attached at an acute angle to the mast.

In an alternative embodiment the luff extrusion is not parallel to the mast, but at an acute angle to the mast, as shown in FIG. 11. Referring now to this figure, it is seen that the lower end of luff extrusion 8 is farther away from the mast than the upper end of the luff extrusion. This configuration is sometimes made to effect different sailing characteristics, and is well known in the art.

Under the geometry shown in FIG. 11, the optimum sail shape is effected by having the vertical axis of rotation 96 of the gooseneck align with the point 98 at which the vertical axis of rotation of the luff extrusion passes through the bottom of the luff extrusion, as shown.

The Feeder Assembly

In prior art furling systems, the foot of the sail is fed directly into the boom slot by the action of the rotating mandrel as it pulls the sail into the hollow boom. As explained above, the luff extrusion of the present systems maintains the battens in a state of compression within the u-shaped profile of the extrusion, and as the battens exit through the bottom of the luff extrusion the compression is released, causing them to spring forward. The luff feeder assembly in the present invention insures that the battens are guided smoothly through the boom slot and onto the mandrel as they are released from the luff extrusion.

Figure 7:
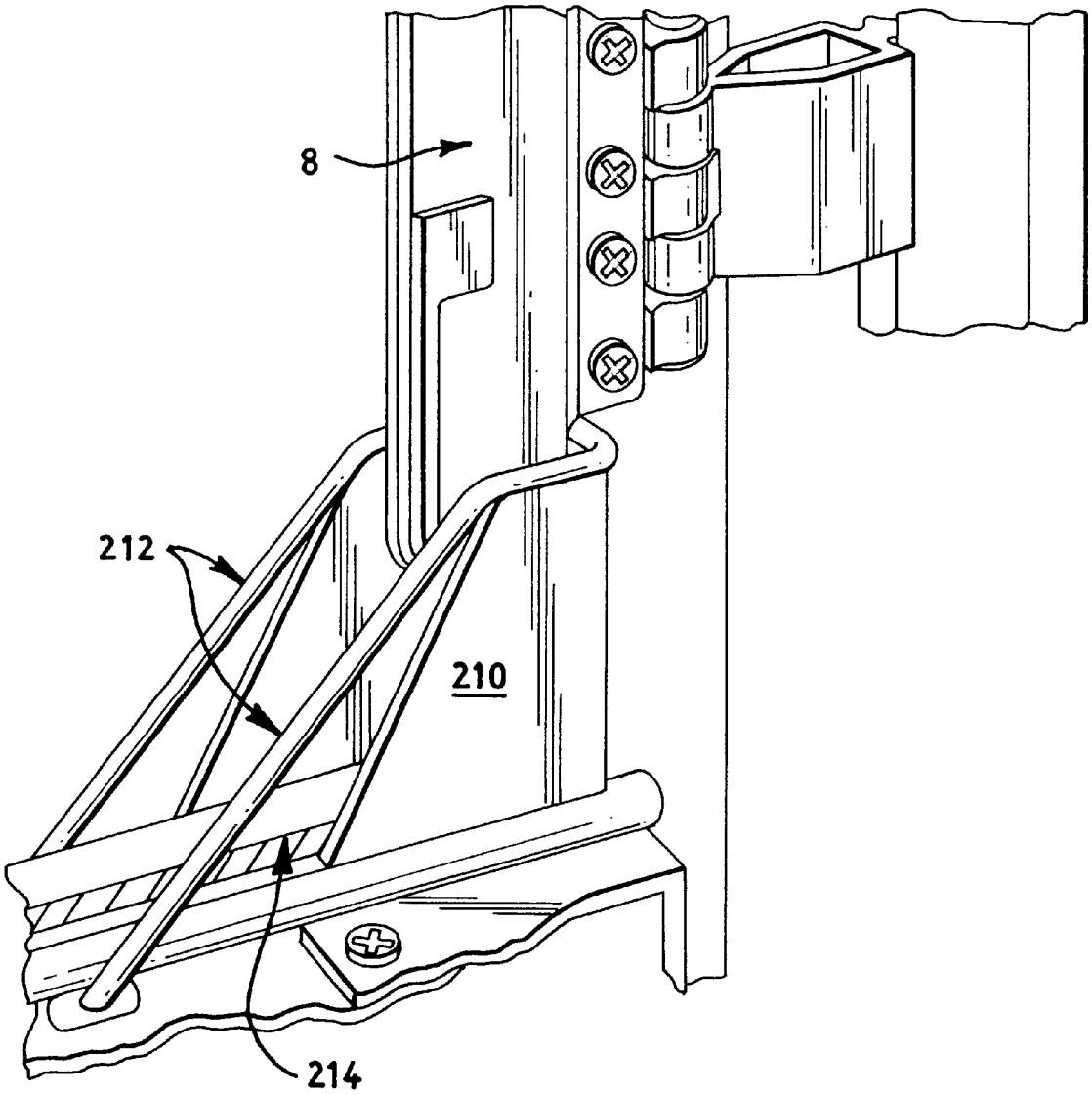
FIG. 7 depicts a perspective view of the feeder assembly.

Referring now to FIG. 7, the feeder assembly is show mounted on the forward end of the top of the boom. The feeder includes a U-shaped fore plate 210, which fits into a feeder slot 214 formed in the top of the boom. The fore plate is further supported by the feeder rod 212, which is also U-shaped, following the contour of the fore plate at its upper end, and attaching to the boom at the two bottom ends.

The luff extrusion 60 extends well into the fore plate, so that the battens are contained at all times as they proceed from the luff extrusion, through the feeder, and into the boom slot.

The Offset Halyard Box

Figure 10:
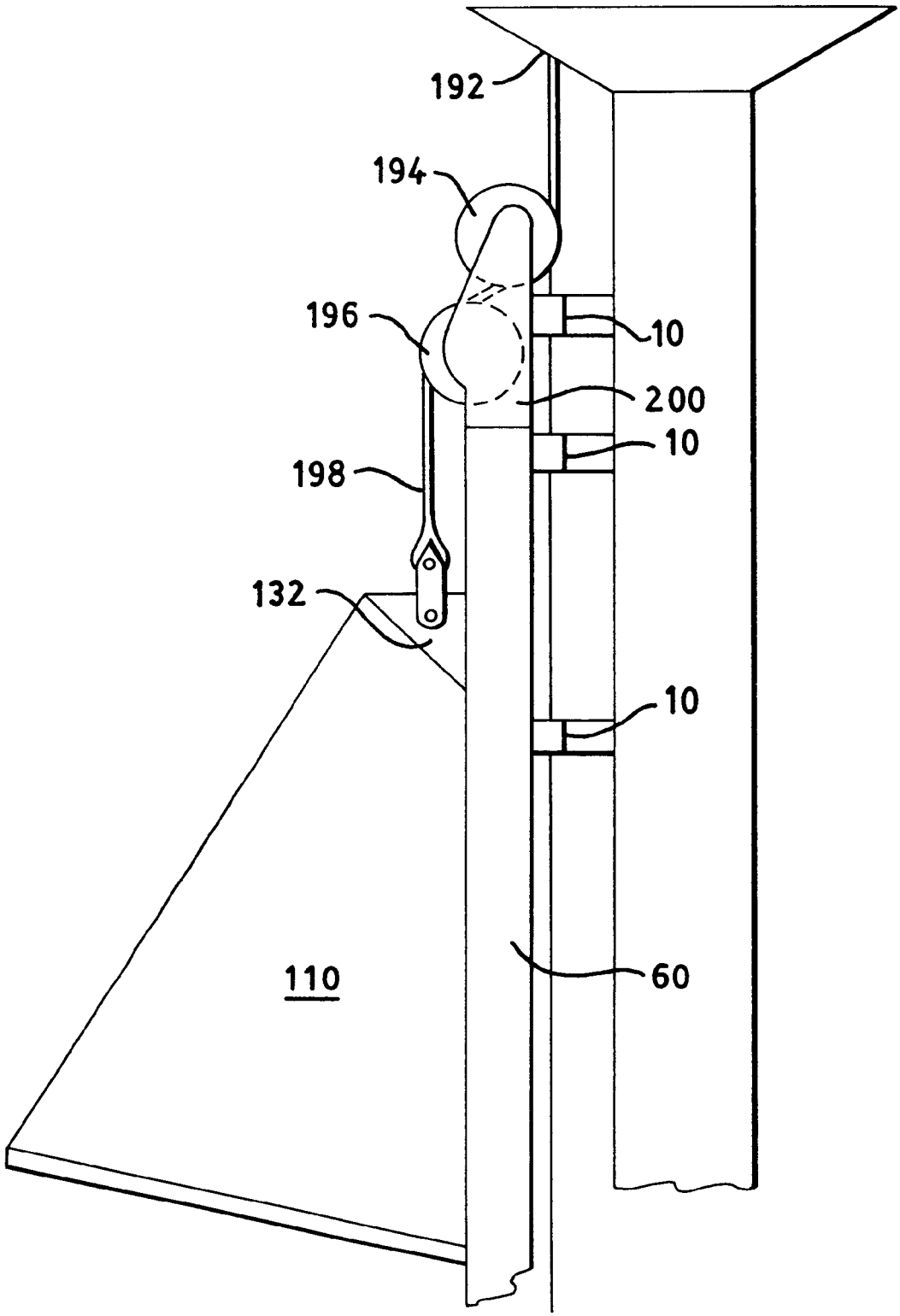
FIG. 10 depicts a side elevation view of the offset halyard box.

Referring now to FIG. 10, it is seen that the main halyard 198 (the rope used to hoist the mainsail) is attached to the head of the sail, usually by means of a headboard plate 132. The halyard 198 can run up the mast either outside the mast, or within, depending upon the manufacturer and model of the boat. FIG. 10 shows an internal halyard which exits near the top of the mast 192 before connecting to the headboard plate.

As previously described in the prior art section, having the luff of the mainsail displaced from the mast causes a strain under certain points of sail, thereby preventing the proper setting of the top of the sail, as further described below.

This problem is addressed by the offset halyard box as shown in FIG. 10. The halyard box 200 terminates the upper end of the luff extrusion 60, as shown. It contains two sheaves, an upper sheave 194 and a lower sheave 196. The halyard 198 runs from the headboard plate 132, around the after end of the lower sheave 196, under the upper sheave 194, and then is redirected upward at the forward end of the upper sheave 194, finally entering the mast at the mast halyard entrance 192.

The effect of his geometry insures that, regardless of the angle between the mainsail and the fore-and-aft axis of the sailboat, the length of the halyard between the halyard mast entrance and the headboard plate will remain constant. To insure this result, the lower sheave is mounted further aft than the upper sheave. Furthermore, the diameter of the lower sheave is such the halyard is parallel to the mast between the headboard plate and the lower sheave. The diameter of the upper sheave is such that the halyard is also parallel to the mast between the upper sheave and the entry into the mast.

A further examination of the geometry of the offset halyard box discloses that, regardless of the angle of the sale relative to the fore-and-aft centerline of the boat, the halyard will exert the same pressure on the headboard plate as at any other angle.

The Gooseneck

The rotating joint between the mast and the boom is called a gooseneck, in accordance with early implementations that had a shape making such a name appropriate. Modem implementations retain the name, although they often bear no such resemblance to the shape of a goose's neck.

In modem yachts having an overall length of thirty feet and larger, the gooseneck often supports the boom from above, or from both above and below, due to the greater forces at play in the case of larger yachts.

Figure 1:
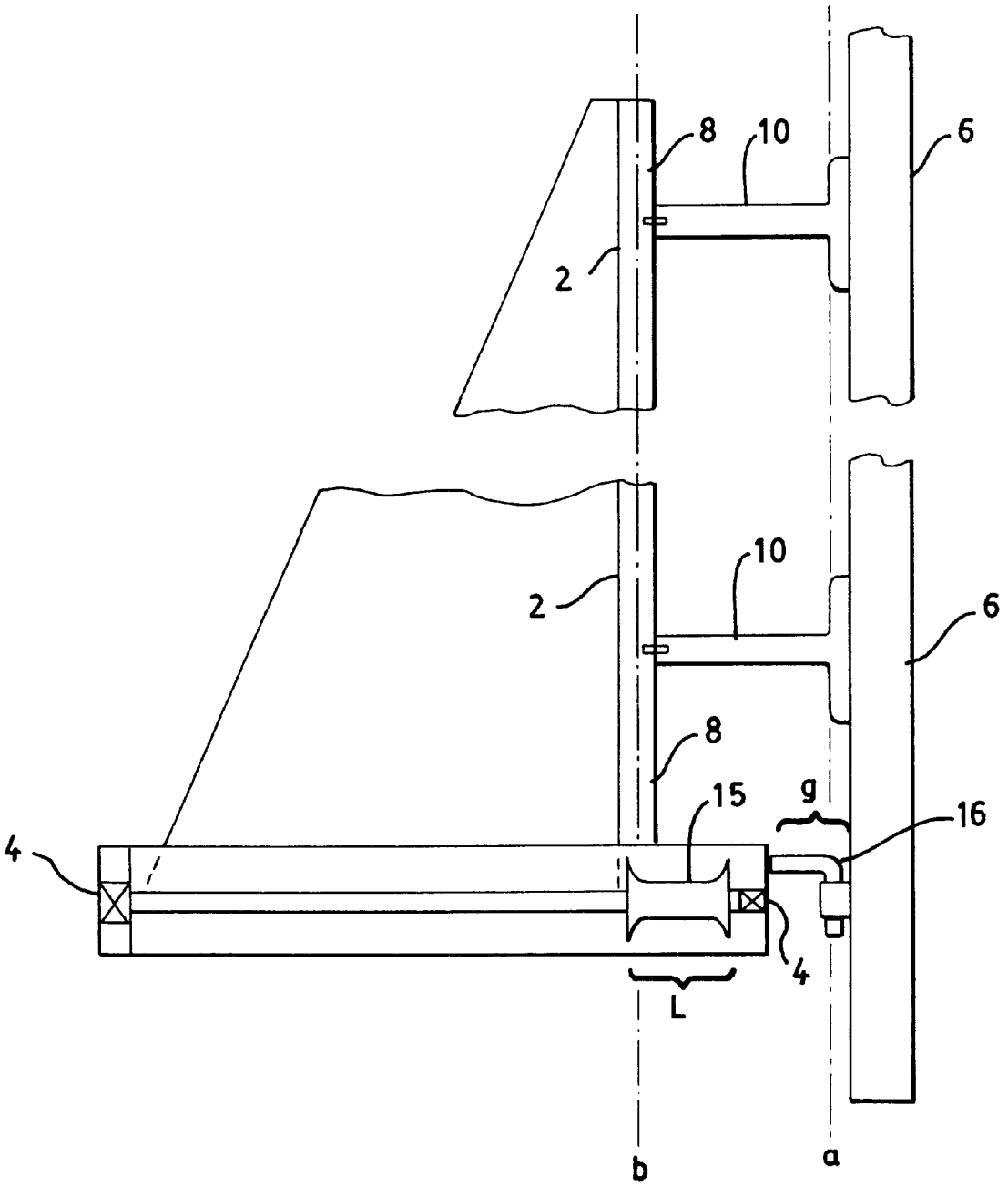
FIG. 1 (PRIOR ART)
FIG. 1 depicts a prior art roller furling system in perspective view.

In the prior art which includes a boom-type roller furler with the drum at the forward end of the boom, a gooseneck which supports the boom from above is acceptable, since the mainsail luff 2 is displaced aft from the mast by at least the width of the drum 15, as seen in FIG. 1.

Figure 4A:
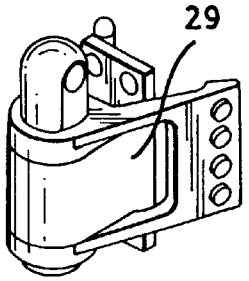
FIG. 4*a* depicts a perspective view of the gooseneck assembly.
Figure 4:
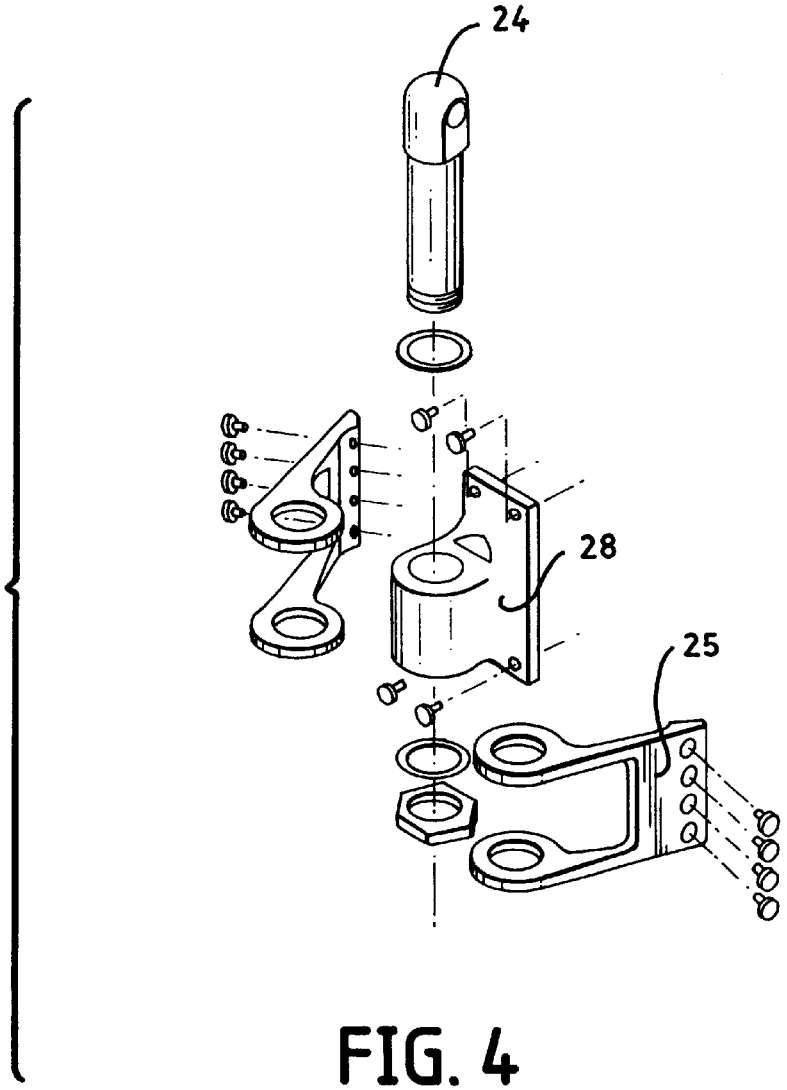
FIG. 4 depicts an exploded view of the gooseneck assembly.
Figure 5:
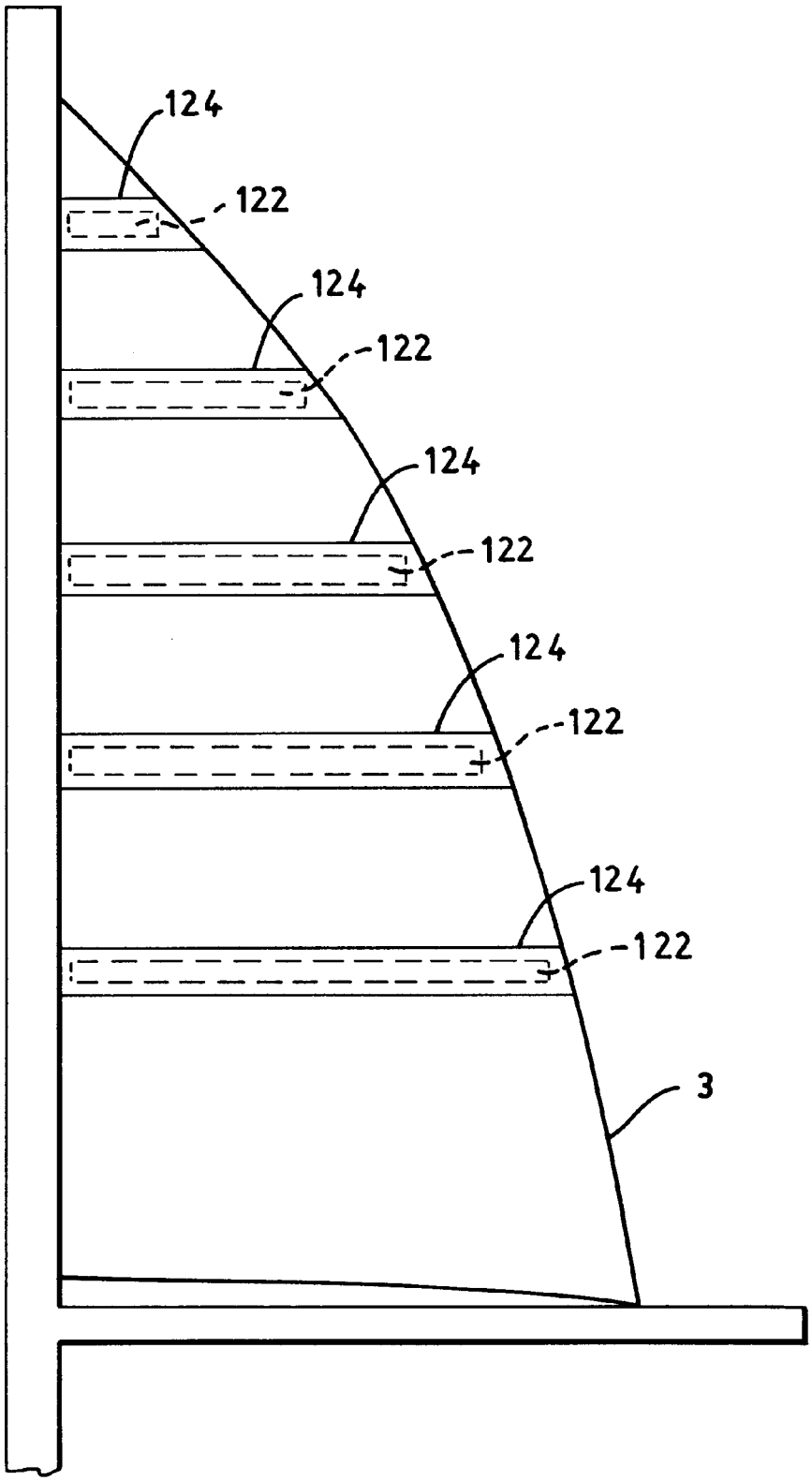
FIG. 5 depicts a fully battened mainsail with battens extending from luff to leach

In the current invention, however, the drum is located at the after end of the boom, and as a result it is desirable to leave the area between the top of the boom and the mast uncluttered to avoid degrading the sail shape. Accordingly, the present invention uses a gooseneck which supports the boom from below, as seen in FIG. 9. Referring now to FIG. 4, the gooseneck assembly 29 is made up of gooseneck sides 25, which capture the gooseneck center to form the completed unit, as shown in FIG. 4*a*. The pin gooseneck pin 24 extends through the gooseneck center as shown, and is fastened from the bottom with a nut and washer as shown. At the top end, the gooseneck pin 24 attaches to the boom, making, in essence a one-point connection. A transverse clevis pin 30 through the eye in the top of the gooseneck pin allows the boom to rotate about a horizontal axis passing through the eye of the gooseneck pin, which also is free to rotate about a vertical axis. The boom vang supplies further support to the boom at a second point 205, as seen in FIG. 9.

Still referring to FIG. 9, the finished gooseneck is attached to the boom by the gooseneck sides, and by the back of the gooseneck center.

The current gooseneck provides the essential features required for all gooseneck fittings, that is, it forms a type of joint, permitting the boom to rotate about two axis. First is the transverse axis, an axis parallel to the deck of the boat, perpendicular to the fore-and-aft centerline of the boat, and passing through the gooseneck at the gooseneck clevis pin in the current invention. The second axis is the vertical axis, which is parallel to the mast, and passes through the gooseneck at the gooseneck pin in the current invention.

In the preferred embodiment of the present invention the vertical axis of rotation of the gooseneck is aligned with the vertical axis of rotation of the luff extrusion, thus providing an optimal sail shape.

An Optimun Sail Shape

Figure 14:
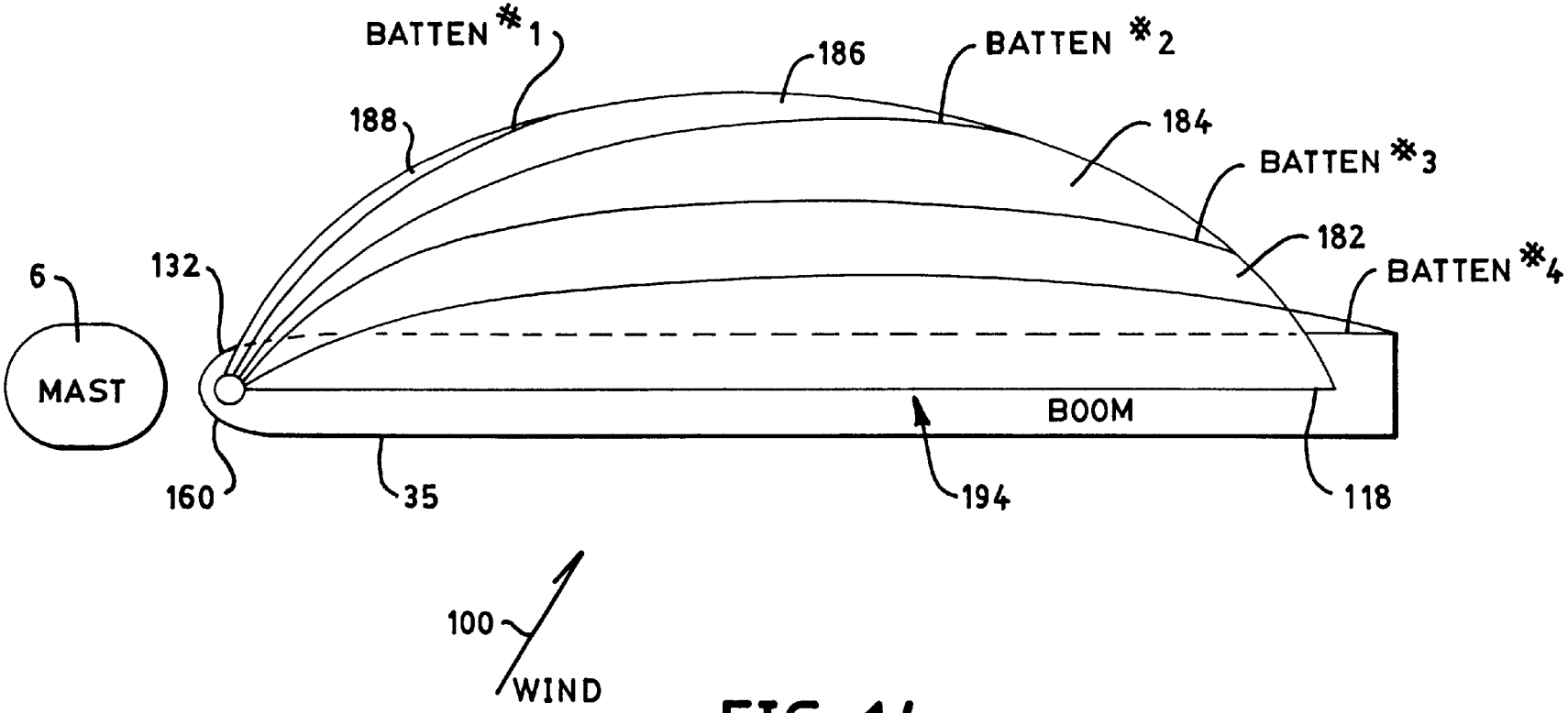
FIG. 14 depicts a top plan view of a mainsail properly set, with cross sections at each of four batten positions and at the headboard plate.

As stated previously, the current invention not only provides ease of operation, but does so while maintaining a proper sail shape, unlike the prior art. It has been mentioned that the proper set of a mainsail, in general, avoids unwanted twists caused by stresses on particular components of the sail and its supporting rigging. A properly set sail produces an airfoil effect, providing the optimum drive to the sailboat, while minimizing unwanted forces produced by the sail which cause such effects as excessive heel, etc. FIG. 14 illustrates an optimum airfoil.

Referring now to FIG. 14, which is a top plan view of a mainsail set on its mast 6 and boom 35, the sail is attached to the boom at the tack, or forward end, 160, and at the clew, or after end 118. In the present invention, as well as in most prior art sailboats, the foot of the sail is also attached along its entire length to the boom. In the prior art the tack and clew are single fixed points of attachment, while, in the case of the present invention, which contains a roller furler within the boom, the foot of the sail is attached along its length by means of the mandrel 3 8, and the tack and clew simply identify the forward and after end of the sail where it attaches to the mandrel (See, for example, FIG. 9).

FIG. 14 depicts the set of the sail, as seen from above, at several cross sections parallel to the deck of the boat. The cross section 182 is closest to the deck, and is also closes to the fore and aft center line 194 of the boom. This cross section contains batten #4 as indicated.

The cross section next farthest away from the deck is 184, containing batten #3. This cross section is farther to leeward (that is, on the side of the boat opposite that first exposed to the wind) than cross section 182.

Next farther from the deck is cross section 186, containing batten #2. This cross section is still farther to leeward than cross section 184, and finally comes cross section 188, containing batten #1. This cross section is the farthest to leeward of all cross sections containing battens.

At the very top of the mast is the headboard plate 132, which terminates the top of the sail, as also seen in FIG. 10. The angle of the headboard plate makes the largest angle with the fore-and-aft line of the boom of all the cross sections shown.

FIG. 14 demonstrates that a properly set sale will be closest to the fore-and aft line of the boom near the deck, and get continuously farther to leeward as the vertical distance from the deck increases. Any of the rigging design features which prevent this naturally-occurring shape tend to diminish to performance of the boat, both in terms of speed and handling characteristics.

Much of the prior art sacrifices performance for comfort. The pre-existing furling systems generally sacrifice performance for the sake of making the rigging easier to handle. The combination of elements which makes up the current invention is designed to provide ease of handling, but without sacrificing performance in any way. This combination is shown in detail in FIG. 9.

Referring again to this Figure, the way that the various components of this system work together is apparent. The sail 110 is seen hoist to the top of the mast 6, and secured at its headboard 132 by means of the offset halyard box 200. The sail is affixed to the mast by means of the u-shaped luff extrusion 8, which enters at its lower end into the feeder assembly 220. The boom vang 230 is seen supporting the lower end of the boom, together with the gooseneck 17. The mandrel 38 is shown contained within the hollow boom, supported by its forward 80 and rear 82 bearings. The drum 88 which provides for rotary motion of the mandrel, is mounted at the after end of the boom. Within the boom, sail guides 86 help guide and contain the furled sail. The winding cord 160 travels from the drum 88, around after winding cord sheave, and forward through a winding cord chamber, or conduit, located at the bottom of the boom. The direction of the winding cord is changed by forward winding cord sheave 162, then onto winding cord deck block 164, and thence aft to the cockpit.

The combination of these elements provides an optimum ease of control, while still maintaining the best sail shape possible, as shown in the foregoing discussion.

Numerous modifications to and alternative embodiments of the present invention will be apparent to those skilled in the art in view of the foregoing description. Accordingly, this description is to be construed as illustrative only and is for the purpose of teaching those skilled in the art the best mode of carrying out the invention. Details of the embodiment may be varied without departing from the spirit of the invention, and the exclusive use of all modifications which come within the scope of the appended claims is reserved.

We claim:

1. A sail furling system, for furling a sailboat sail attachable to a mast, comprising:

(a) a hollow boom having a longitudinal axis, an upper surface, a forward end and an after end, with a boom slot along the upper surface, and further comprising:

(i) a mandrel mounted within the boom, further comprising an after end and a forward end;

(ii) a drum, concentric with the mandrel, and affixed to the after end thereof;

(iii) means to affix a sail to the mandrel;

(iv) means to rotate the drum within the boom, (b) a rotatable boom coupling, affixed at one end below the forward end of the boom, and affixed at the other end to the mast, creating a transverse axis of rotation thereby, said coupling further comprising a vertical axis of rotation substantially parallel to the mast, and (c) a sail feeder, further comprising:

i) two side pieces, affixed on either side of the boom slot, and extending upwards along a forward end of the boom slot;

ii) an end piece, disposed between the boom slot and the mast, attached to each of the side pieces and to the boom itself, the two side pieces and the end piece forming a un-shaped structure when viewed from above, so that the sail is guided into the boom slot by the sail feeder as the sail exits from the bottom of the luff extrusion, so that the entire boom slot is exposed, and whereby, when the drum is rotated, the sail is furled about the mandrel within the boom.

2. The furling system of claim 1, comprising a boom vang, rotatably attached at one end in proximity to the base of the mast, and rotatably attached at the other end to an underside of the boom, permitting the boom to rotate about an axis substantially parallel to the mast, the boom vang supporting part of the weight of the boom thereby.

3. The furling system of claim 2, further comprising a luff extrusion, having a substantially uniform cross section, rotatably attached to the mast, and having a vertical axis of rotation substantially parallel to and in proximity with the vertical axis of rotation of the boom coupling, the luff extrusion cross section having one or more batten guides, each formed by a pair of batten guide arms, one on either side of the batten guide, so that battens extending to the luff of a mainsail attached to the luff extrusion are maintained in compression between the arms of the batten guide.

4. The furling system of claim 2, further comprising a luff extrusion, having a vertical axis of rotation at an acute angle to, and in proximity to the vertical axis of rotation of the boom coupling at the lowest point of the luff extrusion, the luff extrusion cross section having one or more batten guides, each formed by a pair of batten guide arms, one on either side of the batten guide, so that battens extending to the luff of a mainsail attached to the luff extrusion are maintained in compression between the arms of the batten guide.

5. The furling system of claims 3 or 4, wherein the cross section of the luff extrusion further comprises one or more luff rope slots, and further comprising means to capture a luff rope attached to the sail within one of the luff rope slots.

6. The furling system of claim 5, wherein the sail is raised by a halyard, and further comprising:

(a) means to lead the halyard vertically from a head of the sail in close proximity to the luff extrusion to a first rotation point;

(b) means to rotationally redirect the halyard from the first rotation point to a second rotation point in close proximity to the mast; and (c) means to lead the halyard from the second rotation point vertically to a halyard mast exit at the top of the mast, so that the linear length of the halyard, as measured from the halyard mast exit to the head of the sail, does not vary with a point of sail.

7. The furling system of claim 6, wherein the sailboat has one or more sails which are fully battened, and wherein the guide arms further comprise substantially parallel guide arms equally spaced to contain the luff and battens.

8. The furling system of claim 7, wherein the rotatable attachment between the luff extrusion and the mast further comprises a multiplicity of luff supports, wherein the luff extrusion cross section has formed within its forward end a luff support slot, and wherein said luff supports are captured within said luff support slot.

9. The furling system of claim 8, further comprising a forward bearing affixed to the mast end of the boom, and providing rotational support for the forward end of the mandrel, and an after bearing, affixed to the after end of the boom, and providing rotational support for the after end of the mandrel.

10. The furling system of claim 9, wherein the boom further comprises a conduit running along a longitudinal axis of the boom, and wherein the means for rotating the drum further comprising an after pulley, a forward pulley, and a winding line, the winding line winding about the drum, redirected by the after pulley through the conduit, and redirected again by the forward pulley out of the boom, so that when the sail is raised the drum line is wound about the pulley, the mandrel rotating in one direction, and when the sail is in the raised position and the drum line pulled, the drum and attached mandrel is rotated in the other direction, the sail being wound about the mandrel as a result.

11. The furling system of claim 10, wherein the means for rotating the drum further comprises a motor, mounted in the after end of the boom in proximity to the drum.

12. The furling system of claim 11, wherein the motor is further coupled to the drum by reducing gear means.

13. A luff extrusion for slidingly attaching a sail luff comprising one or more full-width battens to a mast of a sailboat, the luff extrusion having a substantially uniform cross section, and said cross section comprising:

(a) two or more substantially parallel batten guide arms creating a batten guide between each pair of adjacent batten guide arms;

(b) a luff extrusion body into which one or more luff rope slots is formed forward of each batten guide, and one or more luff passages is formed communicating between each batten guide and the corresponding luff rope slot; and (c) means for rotatingly attaching the luff extrusion to the mast, wherein each luff passage is sufficiently smaller than the corresponding luff rope slot to permit the capture of the corresponding luff rope within the corresponding luff rope slot.

14. The luff extrusion of claim 13, wherein the luff extrusion body has a track support slot formed within its forward end.

15. The luff extrusion of claim 14, further comprising a luff hinge plate, captured within the track support slot, the luff hinge plate rotatably attachable to the mast.

16. The luff extrusion of claim 15, wherein the means for rotatably attaching the luff extrusion to the mast comprises a luff hinge plate integrally formed in the forward end of the luff extrusion body.

17. The luff extrusion of claim 16, wherein each of the batten guide arms is approximately between ¾ inch and one inch in length, wherein each luff rope slot is about ⅝ inch in width, and slightly greater than ¼ inch in length, wherein the track support slot is approximately ¾ inch in length, and wherein the cross-section of the body measures about ⅞ inch a its point of greatest width.

18. A sail rigging system for a sailboat comprising the following elements in combination:

(a) a hollow boom having a longitudinal axis, an upper surface, a forward end and an after end, with a slot along the upper surface, and further comprising (v) a mandrel mounted within the boom, further comprising an after end and a forward end;

(vi) a drum, concentric with the mandrel, and affixed to an end thereof;

(vii) means to affix a sail to the mandrel;

(viii) means to rotate the drum within the boom, (b) a rotatable boom coupling, affixed at one end to the forward end of the boom, and affixed at the other end to the mast, creating a transverse axis of rotation thereby, said coupling also comprising a vertical axis of rotation parallel to the mast;

(c) a luff extrusion for slidingly attaching the sail comprising one or more full-width battens to a mast of a sailboat, the luff extrusion further comprising:

(i) two or more substantially parallel batten guide arms creating a batten guide between each pair of adjacent batten guide arms;

(ii) means for attaching the sail luff to the luff extrusion; and (d) means for rotatingly attaching the luff extrusion to the mast, so that when the drum is rotated, the sail is furled about the mandrel within the boom.

19. The sail rigging system of claim 18, wherein the each sail further comprises a luff rope attached to the luff of the sail, and wherein the means for attaching the sail luff to the luff extrusion further comprises a luff extrusion body into which one or more luff rope slots is formed forward of each batten guide, and one or more luff passages is formed communicating between each batten guide and the corresponding luff rope slot, wherein each luff passage is sufficiently smaller than the corresponding luff rope slot to permit the capture of the corresponding luff rope within the corresponding luff rope slot.

* * * * *